US005901692A

United States Patent [19]

Allshouse et al.

[11] Patent Number: 5,901,692

[45] Date of Patent: May 11, 1999

[54] COMPOUND ARCHERY BOW

[75] Inventors: James R. Allshouse, Newburgh, Ind.; Christopher Peter Petrole, Chicago, Ill.

[73] Assignee: Indian Industries, Evansville, Ind.

[21] Appl. No.: 09/037,278

[22] Filed: Mar. 9, 1998

Related U.S. Application Data

[62] Division of application No. 08/732,841, Oct. 15, 1996.

[51] Int. Cl.[6] ..... F41B 5/00

[52] U.S. Cl. ..... 124/23.1; 124/25.6; 124/86

[58] Field of Search ..... 124/23.1, 25, 25.6, 124/86, 88

[56] References Cited

U.S. PATENT DOCUMENTS

| | | | |
|---|---|---|---|
| D. 237,491 | 11/1975 | McArdle . | |
| 1,161,642 | 11/1915 | Enos, Jr. . | |
| 2,100,317 | 11/1937 | Hickman . | |
| 2,815,015 | 12/1957 | Giacomo . | |
| 3,486,495 | 12/1969 | Allen | 124/25.6 |
| 3,965,883 | 6/1976 | Meyer . | |
| 4,018,205 | 4/1977 | Meyer . | |
| 4,060,066 | 11/1977 | Kudlacek | 124/25.6 |
| 4,064,862 | 12/1977 | Groner | 124/25.6 |
| 4,178,904 | 12/1979 | Meininger . | |
| 4,515,142 | 5/1985 | Nurney . | |
| 4,519,374 | 5/1985 | Miller . | |
| 4,649,890 | 3/1987 | Powers . | |
| 4,712,533 | 12/1987 | Cruise . | |
| 4,722,317 | 2/1988 | Hartwig . | |
| 4,733,647 | 3/1988 | Mattheck . | |
| 4,739,744 | 4/1988 | Nurney . | |
| 4,976,250 | 12/1990 | Jeffrey | 124/25 |
| 4,986,250 | 1/1991 | Darlington | 124/25.6 |
| 4,989,577 | 2/1991 | Bixby | 124/25.6 |
| 5,054,462 | 10/1991 | Larson | 124/25.6 |
| 5,172,679 | 12/1992 | Mussack | 124/25.6 |
| 5,211,155 | 5/1993 | Zamojski | 124/25.6 |
| 5,390,655 | 2/1995 | Mitchell et al. | 124/25.6 |
| 5,495,843 | 3/1996 | Larson | 124/25.6 |
| 5,499,618 | 3/1996 | Thompson | 124/25.6 |

*Primary Examiner*—John A. Ricci
*Attorney, Agent, or Firm*—Woodard, Emhardt, Naughton Moriarty & McNett

[57] ABSTRACT

Disclosed is a compound archery bow having a handle, a pair of resilient bow limbs, and a pulley system for providing let off. Each of the bow limbs has a mounting portion, attached to the handle, and an opposing tip portion which mounts a cam wheel. A bowstring and take-up string are mounted under tension between the cam wheels. The bow limbs are pre-curved; when not under tension and fastened to the handle, the limbs have a curved portion having a radius of curvature of less than about 30 inches, the radius sweeping an angle of at least about 35 degrees such that the tip end is located rearward of the mounting end a distance of at least about two inches.

10 Claims, 11 Drawing Sheets

COMPOUND ARCHERY BOW

This Application is a Division of Ser. No. 08/732,841, filed Oct. 15, 1996.

BACKGROUND OF THE INVENTION

The present invention relates to archery bows and, more particularly, to improvements which provide a faster and more accurate delivery of an arrow with a compound bow.

One existing bow design is the medieval long bow. In order for a long bow to be effective, it must be relatively long—about 6 feet. These bows can be readily manufactured from available material such as wood, but consequently are sensitive to humidity and temperature changes.

Another existing bow design which performs better in some respects than the long bow is the recurved bow. This type of bow has S-shaped or "recurved" limbs attached to either side of a rigid handle. When the limbs are made from appropriate laminate materials, a relatively short and still highly efficient bow can be made. However, the extent of recurvature is limited due to undesirable twisting of the limbs. Also, like the long bow, traditional recurved bows do not provide a way to hold an arrow in a drawn position without excessive fatigue of the user. U.S. Pat. No. 4,018,205 to Meyer provides illustrations and further detailed discussion about conventional long bows and recurved bows.

In response to the shortcomings of the simple long bow and recurved bow, the compound bow was developed. The compound bow offers several mechanical advantages over traditional straight and recurved bows. By and large, compound bows store more energy than non-compound bows. Also, a compound bow is generally more compact in terms of size for a given energy storage capacity.

Compound bows use a pulley system to provide a property called "let off." Let off results when the force required to hold the bowstring at full draw is substantially less than the force required to hold the bowstring in an intermediate position between the undrawn and fully drawn positions. Upon release of a bowstring which has been loaded with an arrow, the force propelling the arrow at a given position while in contact with the bowstring is proportional to the force required to hold the bowstring stationary in that position. Thus, in a compound bow, the arrow is subjected to a higher acceleration at an intermediate position during release than generally possible with a traditional bow of the same holding force at full draw. As a result, the archer is subjected to lower stress while aiming at full draw than for traditional bow designs.

Referring to FIG. 1A, a conventional compound bow 1 is illustrated. Generally, compound bow 1 comprises handle 2 connected to a pair of oppositely disposed bow limbs 30. A let off pulley system 10 including bowstring 20 is attached to each bow limb 30 and interposed therebetween. Typically, an arrow (not shown) is loaded along arrow path axis 8. Energy to propel a loaded arrow upon release is stored in each bow limb 30 by pulling bowstring 20 from the undrawn position shown in solid lines to the fully drawn position represented in phantom in FIG. 1A. The pair of bow limbs 30 act as springs which store energy when flexed by drawing bowstring 20.

Handle 2 is configured for gripping and includes arrow rest or ledge 3 upon which an arrow for shooting is placed. Handle 2 includes a pair of oppositely disposed limb seats 5 configured to receive mounting portion 32 of each bow limb 30. Each of the pair of screws 6 attaches a corresponding bow limb 30 to a corresponding limb seat 5 of handle 2.

Each of the pair of bow limbs 30 extends from handle 2 rearwardly towards bowstring 20. Each bow limb 30 has tip portion 34 opposing mounting portion 32. Each tip portion 34 is positioned outward from handle 2. Each bow limb 30 has inner edge 36 opposing outer edge 38 along its length. Also, each tip portion 34 corresponding to a bow limb 30 is connected to pulley system 10.

Pulley system 10 includes a pair of wheels 16 each correspondingly mounted to a bow limb 30 by one of a pair of pins 18. Also, pulley system 10 includes cables 12 and bowstring 20 attached between the pair of wheels 16. Cables 12 are also attached to each bow limb 30 by anchor 14. Each wheel 16 rotates or pivots about a rotational axis along corresponding pin 18. Wheel 16 includes cam sections which cooperate with cables 12 and bowstring 20 to provide let off when bowstring 20 is fully drawn. For more details concerning various let off pulley systems, see U.S. Pat. Nos. 4,739,744 and 4,515,142 to Nurney and 4,519,374 to Miller which are hereby incorporated by reference.

Referring to FIGS. 1B and 1C, bow limb 30 is depicted prior to assembly into bow 1. Notably, bow limb 30 is generally flat and straight prior to assembly. Mounting portion 32 defines aperture 32*a* adapted to receive a corresponding screw 6 therethrough. Bow limb 30 has flares or shoulders 33. Tip portion 34 defines slot 35 between arms 34*a* and 34*b*. Slot 35 is configured to receive one of the pair of wheels 16 for mounting therein. Arm 34*a* defines bore 35*a*, and aligns with bore 35*b* defined by arm 34*b*. Bores 35*a*, 35*b* are configured to receive pin 18 for pivotably mounting each wheel 16 to tip portion 34.

Referring specifically to the side view of FIG. 1C, it should be noted that bow limb 30 has thin portion 39 in between mounting portion 32 and tip portion 34. Typically, bow limb 30 is initially a rectilinear blank which is formed by removing material along edge 36. Notably, upper edge 38 remains generally straight even after thinning.

Referring back to FIG. 1A, it should be noted that when assembled into bow 1, bow limb 30 is restrained in a bent configuration between handle 2 and pulley system 10. Notably, thin portion 39 corresponds to the most severe degree of curvature in the bent bow limb 30 when assembled into bow 1. Each bow limb 30 bends even further in the fully drawn position.

One problem which remains with a conventional compound bow, such as bow 1, is that a considerable amount of energy stored in bow limb 30 is wasted by propelling the bow limb 30 forward when drawn bowstring 20 is released. Instead, it is desirable to use at least a portion of this wasted energy to propel an arrow. Force vectors F1 and F2 of FIG. 1D represent the force corresponding to each of the pair of bow limbs 30 at the point of release of a drawn bowstring 20. F1 and F2 are resolved into components along perpendicular coordinate axes x and y. Notably, the y axis generally corresponds to the bowstring 20 and the x axis generally corresponds to the arrow path axis 8 shown in FIG. 1A. Due to the general symmetry of bow 1 about axis 8, y components $F1_y$ and $F2_y$ are of approximately equal magnitude, but are oriented in opposite directions. As a result, the y components of F1 and F2 generally cancel each other. However, the x axis components $F1_x$ and $F2_x$ have generally the same direction; and so represent the force propelling bow limbs 30 forward when bowstring 20 is released with an arrow from the fully drawn position.

Furthermore, this forward motion of each bow limb 30 often causes handle 2 to jerk forward. Sometimes handle 2 even jumps from the archer's hold. These motions usually cause deviations in the flight path of an arrow. In fact, to improve accuracy, archers often minimize confinement of the handle 2 at the moment of release of an arrow through the use of a specially adapted wrist strap to loosely retain the bow.

Another type of conventional compound bow uses recurved limbs. FIGS. 2A and 2B illustrate a typical recurved bow limb 60 prior to assembly. Bow limb 60 has mounting portion 62 defining a mounting aperture 62*a* similar to aperture 32*a* of bow limb 30. Bow limb 60 has a tip portion 64 defining a slot 65 configured to receive a wheel. Slot 65 has arms 64*a,* 64*b* each of which define a bore 65*a,* 65*b* aligned with one another, respectively. Bore 65*a,* 64*b* are configured to receive a pin for pivotably mounting a wheel in slot 65. Bow limb 60 has flares or shoulders 63.

Also, bow limb 60 has recurved portion 70 with a point of inflection 72. Notably, recurved portion 70 has a reverse of curvature about inflection point 72. Bow limb 60 also has a thin portion 69 coinciding with recurved portion 70. Similar to bow limb 30 in FIG. 1A, a pair of bow limbs 60 are opposingly mounted to a handle with inner edge 66 closer to the bowstring than outer edge 68. A wheel is mounted with a rotational axis along bore 65*a* and 65*b* for each bow limb 60. Notably, the inflection point 72 lies along bow limb 60 between mounting portion 62 and bores 65*a,* 65*b* used to mount a wheel. One recurved compound bow design is shown in U.S. Pat. No. 4,712,533 to Cruise which is hereby incorporated by reference.

A compound bow with recurved bow limbs suffers from the same problems caused by forward motion of the bow limb upon arrow release as a compound bow with flat limbs. For both conventional limb types, once the bow limbs are attached to the handle, the corresponding tip portions generally align with an axis along the length of the handle prior to assembly with a pulley system. This generally straight configuration provides a practical limit on the degree of bow limb bending when assembled with a pulley system. This limitation permits substantial bow limb deflection in a direction parallel to the arrow path upon release of a fully drawn bow. Thus, a need remains to reduce the energy expended in propelling the bow limbs forward. Furthermore, at least some of this wasted energy should be redirected into the arrow to increase its speed.

SUMMARY OF THE INVENTION

One feature of the present invention is the novel configuration of a pair bow limbs with an enhanced degree of bow limb curvature. One preferred configuration of a compound archery bow of the present invention incorporating this feature comprises a rigid handle configured for gripping and a pair of resilient bow limbs each with a mounting portion opposing a tip portion. The mounting portion of each of the pair of limbs is attached to the handle opposite the other. Also, each of the tip portions is positioned outward from the handle.

A pulley system for providing let off is included in the bow. This pulley system includes a pair of wheels each pivotally mounted to a corresponding tip portion, and a bowstring mounted under tension between the wheels. The bowstring is configured to engage the arrow for shooting and to flex each of the pair of bow limbs to store energy for shooting the arrow when the bowstring is drawn. Each of the wheels has a corresponding axis of rotation. An axis intersecting the rotational axis of each of the pair of wheels defines a pulley system axis.

Each of the pair of bow limbs extends toward the bowstring along a path from the handle to the tip portion. This path changes direction relative to a selected starting and stopping point. For example, it may turn 75 degrees or more starting from the handle portion and ending at the tip portion. Also, the bow limb may have a pronounced degree of curvature corresponding to the turning path.

When properly configured, a change in direction of the bow limb path concentrates forces acting upon each bow limb from the release of a drawn bowstring to an axis parallel to an undrawn bowstring. Because the pair of bow limbs are generally opposite one another, the forces associated with one bow limb generally cancels the other in such a case. Accordingly, motion of the bow limbs in a direction parallel to the path of an arrow is substantially reduced enhancing accuracy. Also, because these cancelling forces tend to straighten the bowstring, an arrow tends to receive a corresponding increase in propelling force from the bowstring.

Another aspect of the present invention is a compound archery bow having a handle, a pair of resilient bow limbs, and a pulley system for providing let off. Each of the bow limbs has a mounting portion opposing a tip portion. The mounting portion of each of the bow limbs is fastened to the handle opposite the other. The pulley system includes a bowstring, a take-up string, and a pair of cam wheels. The wheels are each pivotally mounted to a corresponding bow limb tip portion with the bowstring and take-up string being mounting under tension therebetween. Each of the wheels includes a peripheral bowstring track with a first working length and a peripheral take-up string track with a second working length. A ratio of the first working length to the second working length is at least about 2.5. For one embodiment of a cam wheel of the present invention, other features may include a radius ratio of the first track maximum radius to the second track maximum radius of at least about 1.75, and a cam ratio of at least about 5 for a drawn position of the bow.

In a further aspect of the present invention, a compound archery bow assembly is provided with a riser and first and second resilient bow limbs fastened to the riser opposite each other. At least the first limb has a free end portion defining a slot. A cam wheel is at least partially received in the slot and journaled to the free end portion to rotate about a rotational axis. For this configuration, the first limb is configured to position the rotational axis a rearward and outward distance from a point of departure of the first limb from the riser. A ratio of the rearward to outward distance is in a range of about 0.2 to 2 when the bow assembly is unstrung. This geometry is characteristic of an unstrung compound bow configured in accordance with the present invention.

One embodiment of a bow limb of the present invention has a mounting portion terminating in a mounting end which defines an opening configured to receive a fastener for attachment to a riser. The bow limb also includes a tip portion defining a slot between a pair of arms. The arms each define an axle passage configured to receive an axle to mount a cam wheel at least partially within the slot. A curved portion integrally connects the mounting portion and tip portions and is configured to rearwardly and outwardly extend the tip portion away from the riser when the mounting portion is fastened thereto. The curved portion generally has a radius of curvature of less than about 30 inches which sweeps an angle of at least about 30°. Preferably, the bow limb is made from a composite material with a polymeric resin and follows a path from the mounting end to the axle passage configured to rearwardly displace the axle passage from the mounting end by at least about 2 inches when the mounting portion is fastened to the riser.

Another embodiment of the present invention includes a compound archery bow with a riser, first and second bow limbs, and a pulley system. The first and second bow limbs are mounted to the riser opposite one another. The first bow limb has a mounting portion fastened to the riser and a tip portion defining a slot between a pair of arms. The pulley system is configured to provide let-off and includes a bowstring, a take-up string, a first cam wheel, and a second cam wheel. The first cam wheel is received at least partially within the slot of the first bow limb and is journaled to the tip portion to rotate about a rotational axis. The second cam wheel is journaled to the second limb. The bowstring and take-up string are mounted under tension between the first and second limbs and each engage the first and second wheels. The first limb follows a curved path to provide an outward and rearward position of the rotational axis relative to a point of departure of the first limb from the riser. This position corresponds to an angle of at least 30° between a first axis tangent to the path of the first limb which intersects the point of departure and a second axis intersecting this point and the rotational axis. This angular relationship corresponds to a compound bow employing various features of the present invention.

Accordingly, one primary object of the present invention is to improve accuracy of a compound bow by reducing forces which tend to jar the bow handle from the archer's grasp.

Another object of the invention is to redirect at least a portion of the energy expanded to propel bow limbs of a compound bow into the arrow to increase arrow speed.

Further objects and features of the present invention will be apparent from the drawings and detailed disclosure which follows.

DESCRIPTION OF THE PREFERRED EMBODIMENT

Figure 1A:
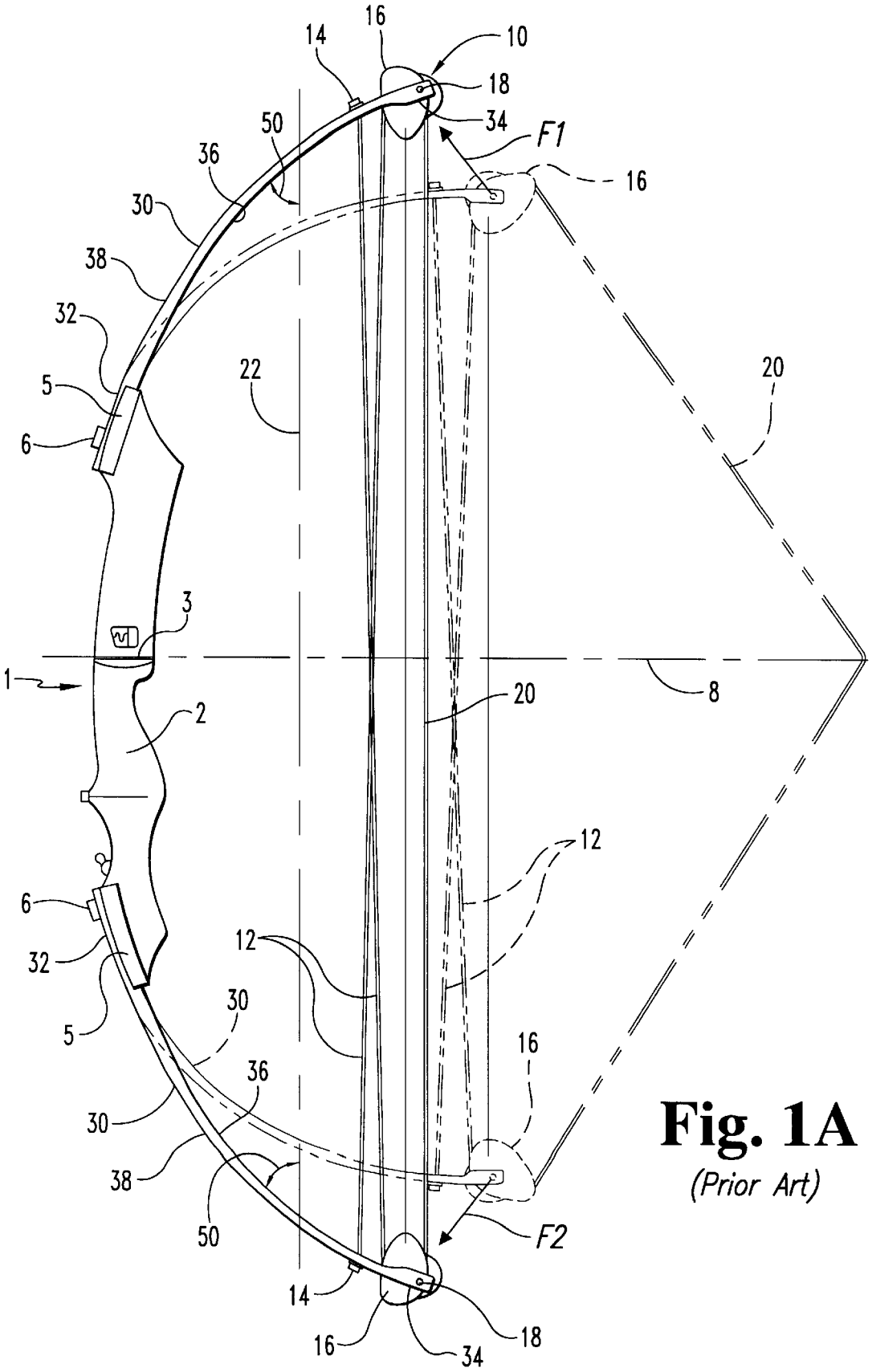
Fig. 1A (Prior Art)
FIG. 1A is a side elevational view of a conventional compound bow shown in the undrawn position in solid lines, and in the fully drawn position in phantom.
Figure 1D:
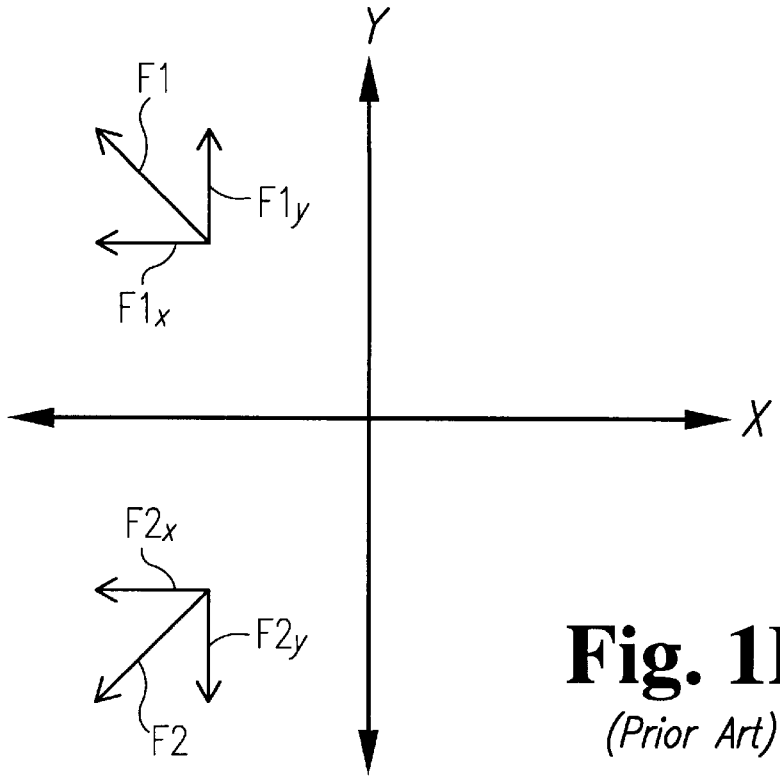
Fig. 1D (Prior Art)
FIG. 1D is a force vector diagram related to the conventional compound bow of FIG. 1A.

For the purposes of promoting an understanding of the principles of the invention, reference will now be made to the embodiment illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

Figure 3:
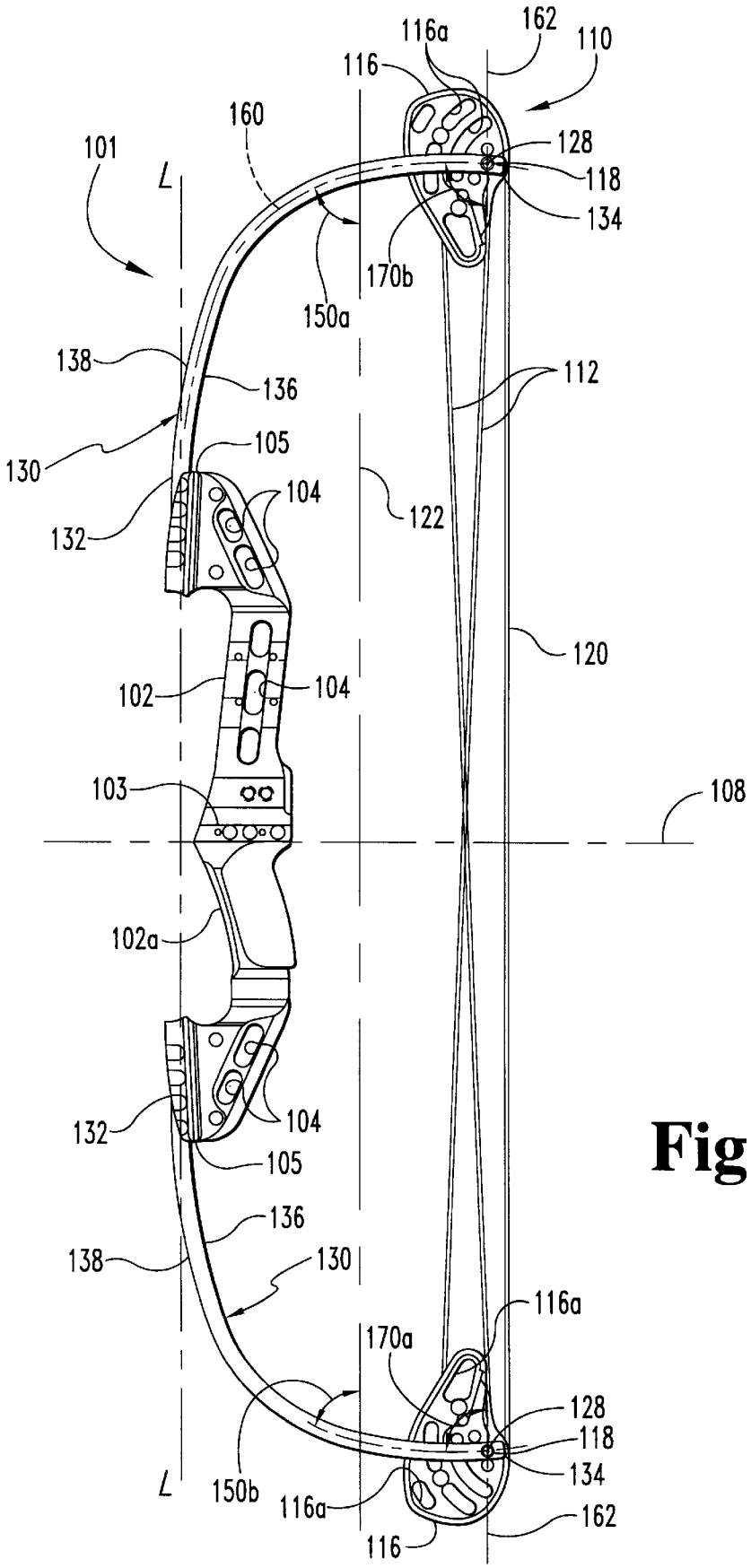
FIG. 3 is a side elevational view of a compound bow of a first preferred embodiment of the present invention.

FIG. 3 depicts a bow 101 of the present invention. Bow 101 comprises handle 102 connected to a pair of oppositely disposed bow limbs 130 about an arrow path axis 108. Each resilient bow limb 130 extends away from handle 102. Bow 101 also includes a pulley system 110 which connects each bow limb 130 to the other and includes bowstring 120. An arrow (not shown) is shot forward from bowstring 120 along arrow path axis 108. It should be noted that axis 108 is generally perpendicular to bowstring 120 when bowstring 120 is undrawn. Drawing bowstring 120 flexes each bow limb 130 which stores energy to shoot an arrow.

Handle 102 is configured with grip 102*a* configured to be grasped by an archer. Also, handle 102 includes arrow ledge 103 and defines a number of openings 104 configured to decrease the weight of handle 102 without sacrificing strength. Preferably, handle 102 is configured to be rigid when exposed to forces typical for its intended use. In one preferred embodiment, handle 102 is made of a metal such as aluminum or steel. In another preferred embodiment, handle 102 is made of a rigid composite material.

Each bow limb 130 has mounting portion 132 attached to a corresponding one of a pair of limb seats 105 of handle 102. The pair of limb seats 105 are disposed opposite one another. In one preferred embodiment, a screw (not shown) is used to attach bow limb 130 to seat 105 similar to screw 6 shown for bow 1 of FIG. 1A. In a variation of this embodiment, an aperture is formed in bow limb 130 with a keyhole and slot shape, by which bow limb 130 is secured to handle 102 using screws. Other techniques of attachment as are known to those skilled in the art are also contemplated.

Each bow limb 130 has tip portion 134 opposite mounting portion 132 which is positioned outward from handle 102. Each bow limb 130 has a bending or working area between the mounting portion 132 and tip portion 134 when assembled into bow 101. Also, each bow limb 130 has inner edge 136 opposing outer edge 138. In one preferred embodiment, the bow limbs are symmetric about an axis positioned therebetween. In one variation of this embodiment, the axis of symmetry is arrow path axis 108.

Let off pulley system 110 includes a pair of wheels 116 each correspondingly mounted to one of the pair of bow limbs 130 by one of a pair of axle pins 118. Also, pulley system 110 includes cables 112 and bowstring 120 attached between the pair of wheels 116. Each of the pair of wheels 116 rotates about the corresponding pin 118. As such, rotational axis 128 is disposed along the length of each pin 118 as represented by a point shown coincident with pin 118 in FIG. 3. Each wheel 116 is generally a mirror impage of the other and defines openings 116*a* which are configured to reduce weight without sacrificing strength. In one preferred embodiment, each wheel 116 is made from a metal. In another preferred embodiment, each wheel 116 is made from a composite material.

Each wheel 116 of pulley system 110 is connected to the other by cables 112 and bowstring 120 interposed therebetween. In FIG. 3, two cables 112 are provided. Each of cables 112 has a first end which terminates at an axle pin 118 of one wheel 116 and an opposing end which is attached to a take-up string track of an opposing wheel 116. In other preferred embodiments, cables 112 terminate at an anchor as shown for the pulley system of FIG. 1A. In FIG. 3, bowstring 120 is continuous between the pair of wheels 116. In other preferred embodiments, bowstring 120 is a segment which can be removed and replaced. Preferably, bowstring 120 is drawn at a knock point at the intersection of arrow path axis 108 with bowstring 120. Similarly, cables 112 can be continuous or segmented or otherwise varied as would occur to one skilled in the art.

In other preferred embodiments a different let off pulley system is adapted for use with bow 101. U.S. Pat. Nos. 5,211,155 and 4,649,890, as well as patents previously incorporated by reference, provide just a few examples of let off pulley systems which can be adapted for use with the present invention. Adaptation of these and other let off means as would occur to one skilled in the art are also contemplated.

Figure 1B:
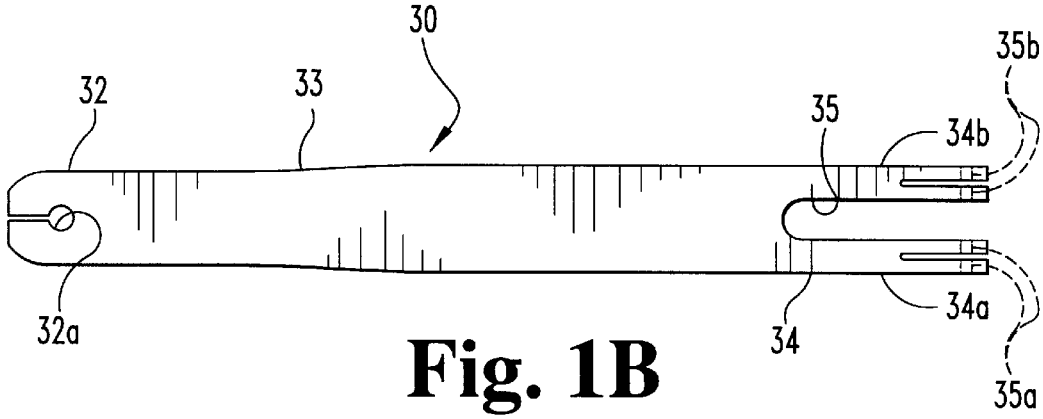
Fig. 1B (Prior Art)
FIG. 1B is a top plan view of a bow limb prior to assembly into the bow of FIG. 1A.
Figure 1C:
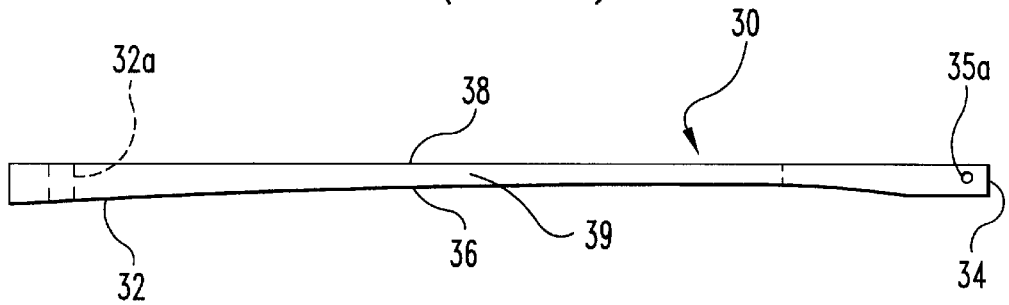
Fig. 1C (Prior Art)
FIG. 1C is a side elevational view of the bow limb of FIG. 1B.
Figure 2A:
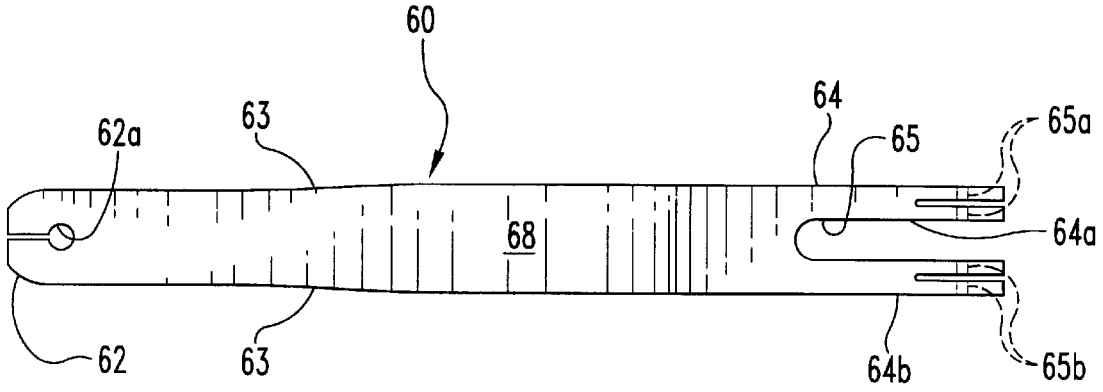
Fig. 2A (Prior Art)
FIG. 2A is a top plan view of a recurved bow limb prior to assembly into a conventional compound bow.
Figure 2B:
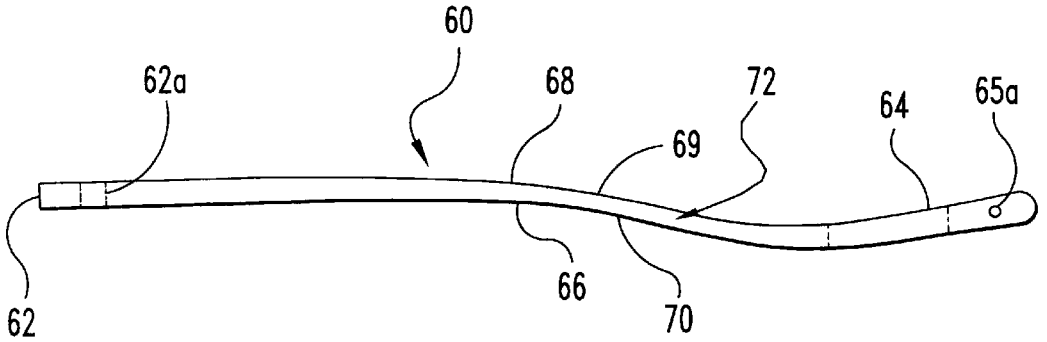
Fig. 2B (Prior Art)
FIG. 2B is a side elevational view of the recurved bow limb of FIG. 2A.
Figure 4:
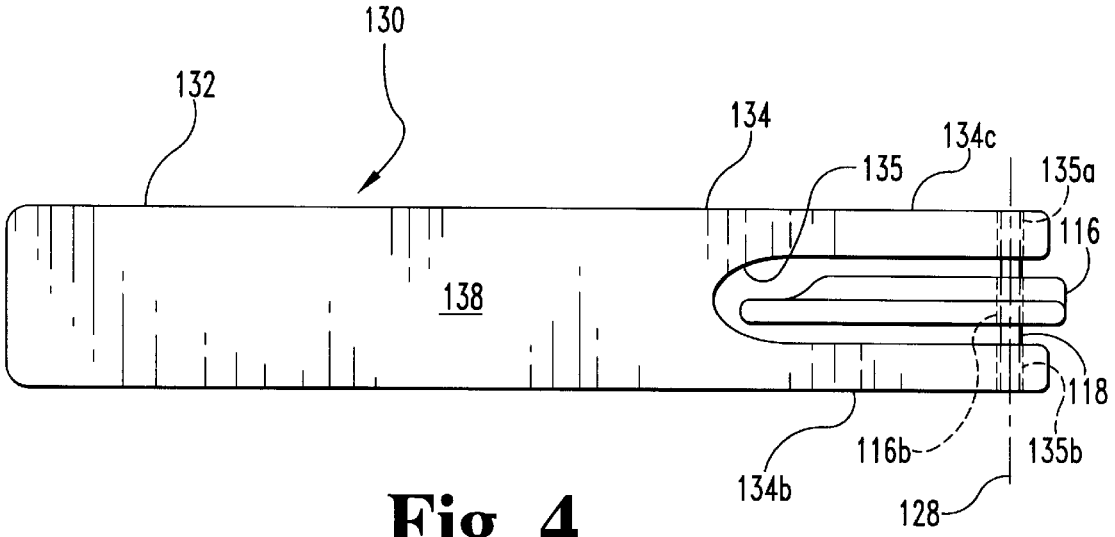
FIG. 4 is a top plan view of a bow limb prior to assembly into the compound bow of FIG. 3 with a wheel and pin portion of a let off pulley system schematically shown.

FIG. 4 depicts bow limb 130 prior to assembly into bow 101. Tip portion 134 of bow limb 130 defines slot 135 with arms 134*a,* 134*b* disposed opposite one another. In one preferred embodiment, slot 135 is formed with a full radius of 180° to minimize stress concentrations which may fatigue bow limb 130. Each arm 134*a,* 134*b* may be further divided into tines as previously illustrated for bow limbs 30 and 60 in FIGS. 1B and 2A, respectively. Wheel 116 is mounted to tip portion 134 by axle pin 118. Bores 135*a,* 135*b* in arms 134*a,* 134*b,* respectively, define an axle passage configured to receive pin 118 to pivotally mount wheel 116 at least partially within slot 135. So mounted, wheel 116 pivots about rotational axis 128 along the length of pin 118.

Figure 5:
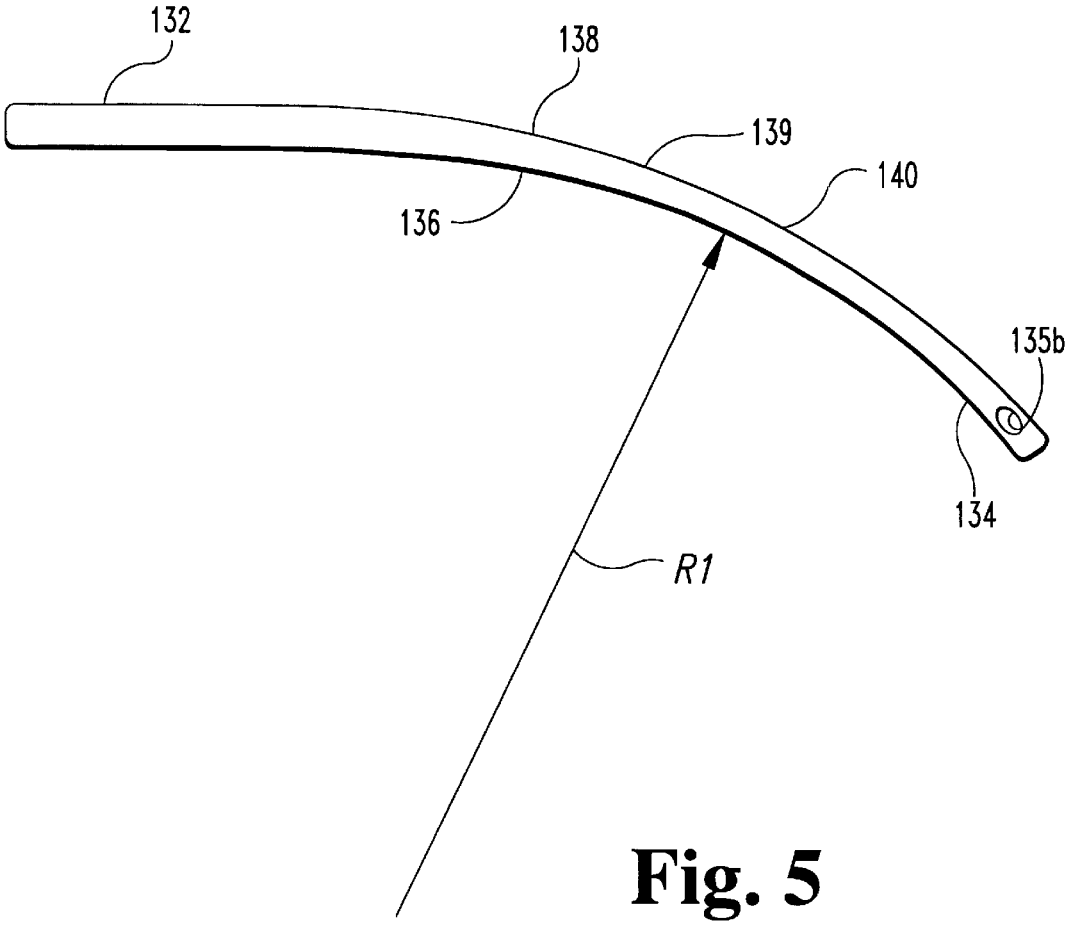
FIG. 5 is a side elevational view of the bow limb at FIG. 4 without the pulley system schematic representation.

FIG. 5 depicts bow limb 130 with curved portion 140 having a radius of curvature R1. Curved portion 140 is pre-curved. As used herein, "pre-curved" refers to the formation of curvature along the length of a bow limb prior to assembly into a bow. Curved portion 140 coincides with a thin portion 139 between inner edge 136 and outer edge 138. Notably, opposing edges 136 and 138 (and corresponding surfaces) of bow limb 130 curve in the same direction along curved portion 140. In one preferred embodiment, curved portion 140 has a simple curvature of radius R1. In another preferred embodiment, curved portion 140 is pre-curved with a compound curvature having multiple radii. In addition, some preferred embodiments do not have thin portion 139. In one preferred embodiment there is about a three inch section from mounting portion 132 to curved portion 140 which is generally flat and straight and a curved portion 140 which is pre-curved with a radius of curvature of about twenty inches in length prior to assembly of bow limb 130 into bow 101.

Figure 6:
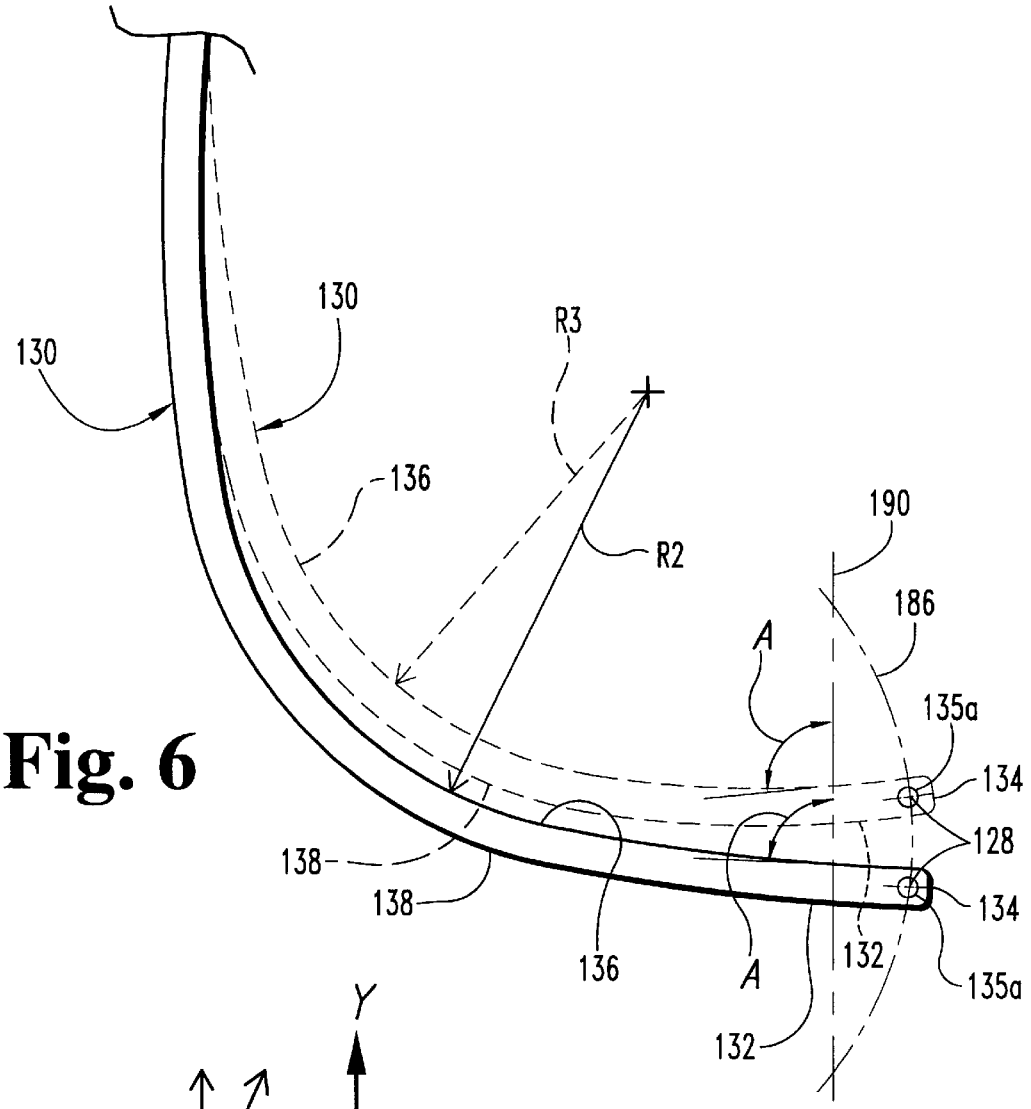
FIG. 6 is a partial schematic side view of the bow limb of FIGS. 4–5 assembled into a compound bow with the drawn position represented by solid lines and the fully drawn position represented in phantom. The pulley system is not shown for clarity.

FIG. 6 depicts a partial side view of bow limb 130 in an undrawn position in solid lines and in a fully drawn position in phantom. The pulley system is not shown for clarity. Referring to FIG. 6, a radius of curvature R2 is shown which is typically less than radius of curvature R1 of FIG. 5 due to further bending of bow limb 130 when assembled. In one preferred embodiment, an R1 of about twenty inches is reduced to an R2 of about nine inches. In the fully drawn position, bow limb 130 may exhibit a greater degree of curvature with correspondingly decreased radius of curvature R3. Also, tip portion 134, and in particular, the rotational axis 128 coincident with bore 135*a* moves along arc 186 as bowstring 120 is drawn. Force vector F10 represents the instantaneous force vector upon release from the fully drawn position. For FIG. 6, the direction of force vector F10 at the tip portion 134 will change as the tip swings through arc 186. In some preferred embodiments, it is anticipated that tip portion 134 will oscillate along arc 186 before coming to rest in the undrawn position. In still other preferred embodiments, the force vector may not appreciably change direction or the direction may change in a different manner from that depicted in FIG. 6.

Figure 7:
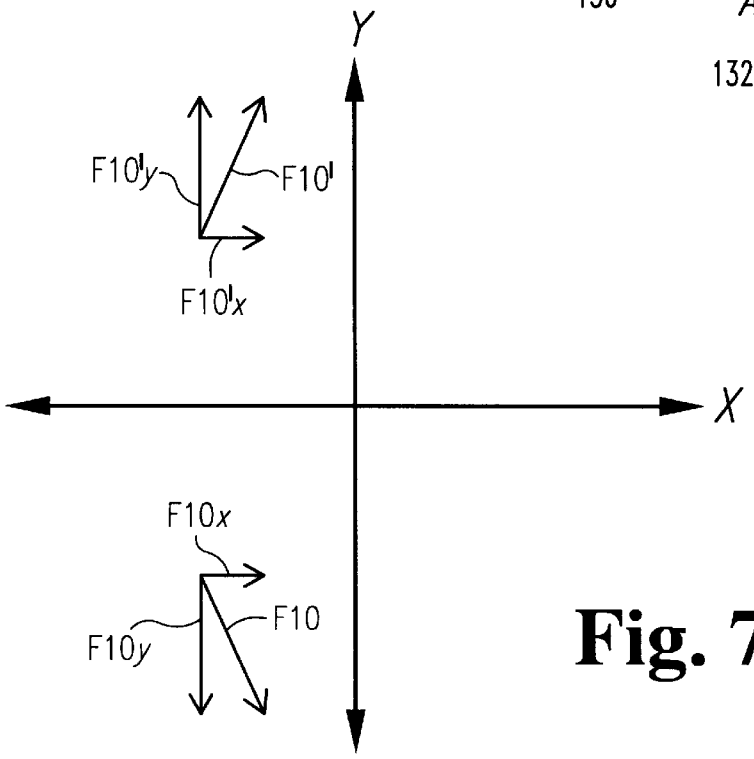
FIG. 7 is a force vector diagram representative of one embodiment of the present invention.

Additionally referring to FIG. 7, F10 is resolved in terms of perpendicular axes x and y. Generally, the x axis corresponds to the arrow path axis 108 and the y axis corresponds to the bowstring 120. Notably, the magnitude of the y axis, $F10'_y$ is relatively larger than for existing compound bow designs. Force vector F10' corresponds to a bow limb 130 opposite the bow limb 130 shown in FIG. 6. For example, force vectors F10, F10' may correspond to the pair of bow limbs 130 symmetrically disposed about arrow path axis 108 as shown in FIG. 3. F10' resolves into y component $F10'_y$ with a magnitude generally equal to $F10_y$. Consequently, $F10'_y$ and $F10_y$ cancel one another which does not adversely impact the flight path of an arrow.

The magnitude along the x axis, represented by $F10_x$ and $F10'_x$ is significantly reduced given the degree of curvature of the bow limbs 130 depicted in the present invention as compared to the conventional bow of FIG. 1A. This reduced magnitude improves accuracy of an arrow when released. For some preferred embodiments, the direction of force along the x axis changes as tip portion 134 moves along arc 186 when it is released.

For conventional compound bows, material properties limit the extent to which a bow limb can be bent and restrained by a pulley system and still meet performance expectations. Specifically, the generally straight configuration of existing bow limbs attached to a handle cannot be bent or restrained by a pulley system to provide the advantageous shape of the bow limbs taught by the present invention and still meet other performance requirements. The pre-curved bow limb 130 offers one way to solve this problem by providing a degree of curvature not possible with existing compound bow designs.

Once assembled, the shape of bow limbs of the present invention can vary depending on the materials used and the specific configuration of bow limbs 130, handle 102 and pulley system 110. In some preferred embodiments, a pronounced curvature is desired. One way to assess the degree of curvature is by determining the angle swept by a radius of curvature from the bow handle to an axis generally parallel to bowstring 120 and intersecting the bow limb at some point. This curvature can be simple or compound. For one preferred embodiment, this angle is at least 75°. In a more preferred embodiment, this angle is at least 80°. In another more preferred embodiment, this angle is least 90°. In the most preferred embodiment, this angle is about 85° so that the curvature swings to about 95° when fully drawn and then rebounds, eventually returning to the 85° curvature when undrawn.

Another way to describe the pronounced change of direction of the bow limb taught by the present invention is by reference to a path which each bow limb follows. As used herein "path" means any line which can be oriented along the bow limb and positioned with the same relative spacing between surfaces or edges of the bow limb inclusive of a line coincident with an edge or surface. The path may be curvilinear, rectilinear, or both. The degree of change along a path is determined relative to designated starting and stopping points such as the handle and tip portion, respectively.

One preferred embodiment of the present invention is described in terms of the bow limb path. Specifically, for a bow limb extending toward the bowstring, the path of the bow limb changes direction or turns at least 75° from the handle to the tip portion. In a more preferred embodiment, the path turns at least 80°. In another more preferred embodiment, the path turns at least 90°. In the most preferred embodiment, the path turns about 85°.

Referring back to FIG. 3, dash line 160 represents one such path which generally maintains an equidistant relationship between inner edge 136 and outer edge 138. Similarly, each edge 136, 138 represents a path along bow limb 130. Notably, a path along either edge 136, 138 is concave toward bowstring 120. An essentially infinite number of paths may be selected for bow limb 130. In one preferred embodiment, the paths are contained in a plane intersecting bowstring 120 and each bow limb 130. One such plane is parallel to the side elevational view of FIG. 3. A tangent to the path of line 160 forms an interior angle 150*a* with an axis 122 generally parallel to bowstring 120.

Notably, the intersection of a tangent and an axis parallel to a bowstring offers four possible angles in a given plane representative of curvature. Planar geometry teaches that the four angles total 360° and that two pairs of opposing angles are formed. Each angle of an opposing pair is equal to the other. As used herein, an "interior angle" for a given bow limb is the angle formed between the segment of a tangent disposed between the axis and a connected bow handle and the segment of the axis disposed between the given bow limb and another bow limb; where the tangent is formed on a path along the given bow limb. For example, a tangent with inner edge 136 forms an interior angle 150*b* with axis 122. Angles 150*a* and 150*b* will be about equal for the configuration of bow limb 130 shown in FIG. 3. Generally, the larger the interior angle is, the greater the curvature of the bow limb.

FIG. 3 depicts a pulley system axis 162 which is generally parallel to axis 122 and bowstring 120. As used herein, a "pulley system axis" or "axle-to-axle axis" intersects the axis of rotation of each of a pair of wheels mounted to oppositely disposed bow limbs of a compound bow. The interior angle with respect to pulley system axis 162 for each bow limb 130 is indicated as interior angle 170*a* and 170*b*. Interior angles 150*a*, 150*b*, 170*a*, and 170*b* all represent one measure of the degree of curvature of bow limb 130 at various points along a path. Other measures of curvature as are known to those skilled in the art are also contemplated.

In one preferred embodiment, the curvature is described as an interior angle of at least 75° between a tangent to a path along each bow limb 130 in an axis generally parallel to bowstring 120; where the interior angle is formed in a plane intersecting the pair of bow limbs 130 and bowstring 120. In a more preferred embodiment, the interior angle for this description is at least 85°. In another more preferred embodiment the angle is at least 90°.

FIG. 6 depicts a most preferred embodiment where interior angle A is about 85° between a tangent to a path along the bow limb 130 and its pulley system axis when bowstring 120 is undrawn, and about 95° when bowstring 120 is fully drawn. The force component along the x axis at the point of intersection by the rotational axis 128 generally reverses direction as it passes through 90° along arc 186.

The bow limbs of the present invention may be made from a composite material. One preferred type of composite bow limb is compression molded from laminated fabric plies. This type of bow limb is composed of fiber layers encased in a homogeneous resin, wherein at least half of the fiber layers are woven sheets of fibers. The woven sheets include longitudinal fibers located along a longitudinal axis through the length of said bow limb and off-axial fibers oriented at a non-zero angle from said longitudinal fibers. The longitudinal fibers are interwoven with said off-axial fibers.

One preferred method of making this type of composite bow limb uses woven glass fibers having various fibers oriented in a non-parallel relationship. One preferred weave has a 90° separation angle. In one preferred embodiment using a "90° orientated" weave material, fibers are included which are generally parallel with the longitudinal axis of the limb (which passes longitudinally through the length of the limb) interwoven with off-axial glass running perpendicular to the longitudinal axis. The off-axial glass aids in distributing the stress along the limb. Similarly, a weave with a separation angle of 30° or 45° is used and various orientations of this weave with respect to the longitudinal axis of the bow limb are contemplated as would occur to those of ordinary skill in the art. Optionally to minimize production costs, layers of unidirectional glass may be used. Preferably 75% to 100% of the limb be made of woven fabric plies having off-axial glass of some orientation (i.e. 90°, 45° or 30°) interwoven with the longitudinally oriented glass. Most preferably, the limb would be assembled entirely of woven fabric plies.

In one preferred embodiment, an E-glass fabric with a predominate number of ends in the warp direction relative to the fill is used. The ratio of warp ends to fill ends in this preferred embodiment is 80% warp×20% fill. The same fabric weave is also used on S-glass plies applied to the tension side of the limb. The S-glass and graphite fabrics are used to increase the strength of the fibers on the tension side of the limb where the highest stresses occur. In one preferred embodiment, E-glass fabric, such as the 7707/7576 fabric weave made by FIBERITE® is used. Additionally, an S-glass fabric, such as the 7707/6576 by FIBERITE® or a graphite weave material may be used in combination with or instead of the E-glass fabric. This is not meant to be limiting as other known fabric weaves may be used.

Preferably, the fabric weave is impregnated with a resin. For example, thin pre-impregnated fabric weaves (or prepreg sheets) are used. In managing the stress and stiffness throughout the limb it may be necessary to build up certain portions of the limb without also building up other portions of the limb. To achieve this, partial length fabric plies are chosen so as to locate the material and the associated stress exactly where it is needed. For example, it has been found that pre-impregnated fabric weaves of a thickness between 0.005–0.030 inches may be used. However it is preferred that pre-impregnated fabric weaves of between 0.007–0.015 inches be used, with the most preferable thickness being chosen from among the range of 0.007–0.012 inches. When using plies of between 0.007–0.012 inches, it is possible, for example, to have 50 plies in a first area of the limb, such as the tip or tangent ends, and have only 25 plies in another area of the limb. Choosing plies of between 0.007–0.012 inches thickness additionally allows for the fine thinning of the limb thickness to obtain bows of different draw weights while maintaining the fiber/resin ratio (i.e. performance life relative to fiber/resin ratio). The distribution of thin weave plies allows for better control of both stiffness and stress along the limb, as well as accurately controlling the above-noted fiber/resin ratio.

In one preferred embodiment, a mold with a base and a contoured top is used to form the bow limb using woven pre-preg fabric. Pre-preg sheets are layered up on a base. Additionally, in order to selectively make the working area of the limb, as well as to provide added stiffness in the tip portion, partial plies may be used. As such, material is placed exactly where it is needed and not where it is not, and thus, the thickness of the resulting limb may be selectively adjusted.

Once the completed bundle of all desired pre-impregnated fabric weaves have been laid up, the contoured mold top is fitted. Heat and pressure are applied so as to make the pre-impregnated resin matrix of the weaves flow freely, thus forming a homogeneous resin system without stress planes or fault lines associated with glue lines. In order to apply sufficient heat and pressure, either an autoclave or compression molding system may be used. In one preferred embodiment, the laid up weaves in the mold are put under 100+/− 10 psi of pressure at about 275°+/−10° F. for about 60 minutes. Curing at a high temperature and pressure ensures that the resin flows evenly throughout the fabric weaves and ensures that the resulting bow limb is homogeneous. Additionally, curing the materials only once, in a single cure cycle improves the strength of the limb, as well as reduces the costs of production. Molding in a single cycle additionally eliminates the internal stress caused by bonding and curing dissimilar materials which is problematic in the prior art. The bow limb may be molded as part of a larger paddle which is sawed into a number of bow limbs after being made.

Further variations of this process include the substitution of S-glass fibers with graphite fibers. Likewise, weaves may be substituted for the E-glass. Further details concerning this process may be found in co-pending U.S. patent application entitled, "Composite Bow Limb," which was filed on Oct. 2, 1995 and invented by James R. Allshouse, Christopher Peter Petrole, Christopher Karl DeLap, Howard Alvin Lindsay, and Scott David Cokeing.

In one preferred embodiment, each bow limb 130 is pre-curved between a mounting portion 132 and a tip portion 134 using this method of manufacture (see FIG. 5). Assembly continues by attaching each mounting portion 132 to the handle 102 as shown in FIG. 3. Wheels 116 are pivotally mounted to each tip portion 134 and configured for interconnection in pulley system 110. One way to accomplish this interconnection is with cables 112 and bowstring 120. However, prior to interconnection, it should be noted that each wheel 116 is positioned to the rear of a plane intersecting handle 102 and each bow limb 130. One such plane is generally perpendicular to the view plane of FIG. 3 and includes axis L shown therein. In this context, "rear" is a relative direction opposite the direction of travel of an arrow shot along axis 108.

For this partial configuration, each bow limb extends along a path which turns at least 35 degrees for one preferred embodiment. In a more preferred embodiment, this path turns at least 45 degrees. In a most preferred embodiment, this path turns between about 38 and 42 degrees. For some preferred embodiments, the curvature along the pre-curved portion of the bow limb increases when assembly with a pulley system is complete as previously discussed in regard to FIG. 6.

Besides the enhanced curvature, it is also desirable to minimize deflection of bow limbs 130 by increasing stiffness. For example in one preferred embodiment, stiffness is increased about two times the stiffness of conventional bow limbs by making the limb thicker. In a variation of this embodiment it is desirable to minimize the increase in weight of the thicker limb, by making it narrower as well as thicker. In other preferred embodiments, materials selection, a change in the moment of inertia of the bow limb, and change in the bow limb beam length may be used to adjust the stiffness.

To achieve comparable performance for a stiffer limb, one preferred embodiment increases the size of the wheel mounted thereto. For one preferred embodiment, this increase is exemplified by comparing the relative difference in size of the wheel in FIG. 3 to FIG. 1A. Furthermore, to prevent a commensurate increase in deflection with the increase in wheel size, the cable or take-up string track of the wheel is generally reduced. For a preferred embodiment having limb stiffness about twice the usual amount for conventional bow limbs, the cable track is reduced about 33% to maintain a reduced deflection.

Figure 8C:
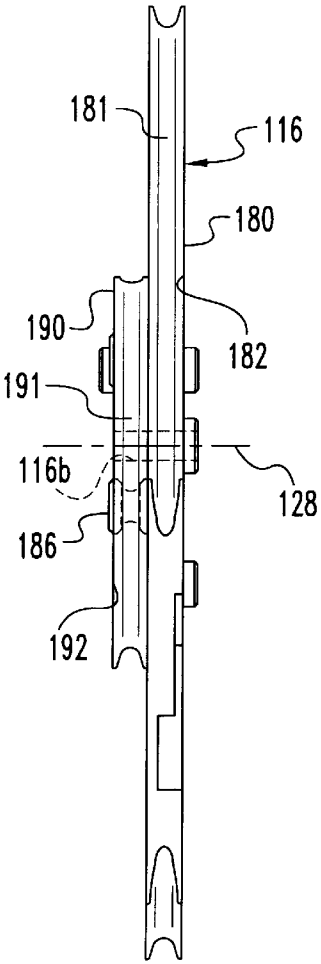
FIGS. 8A, 8B, and 8C illustrate various features of the cam wheel depicted in FIG. 3 in greater detail.
Figure 8B:
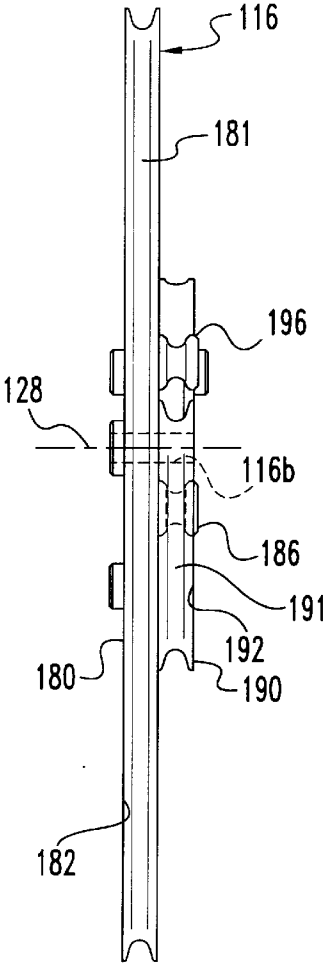
Figure 8A:
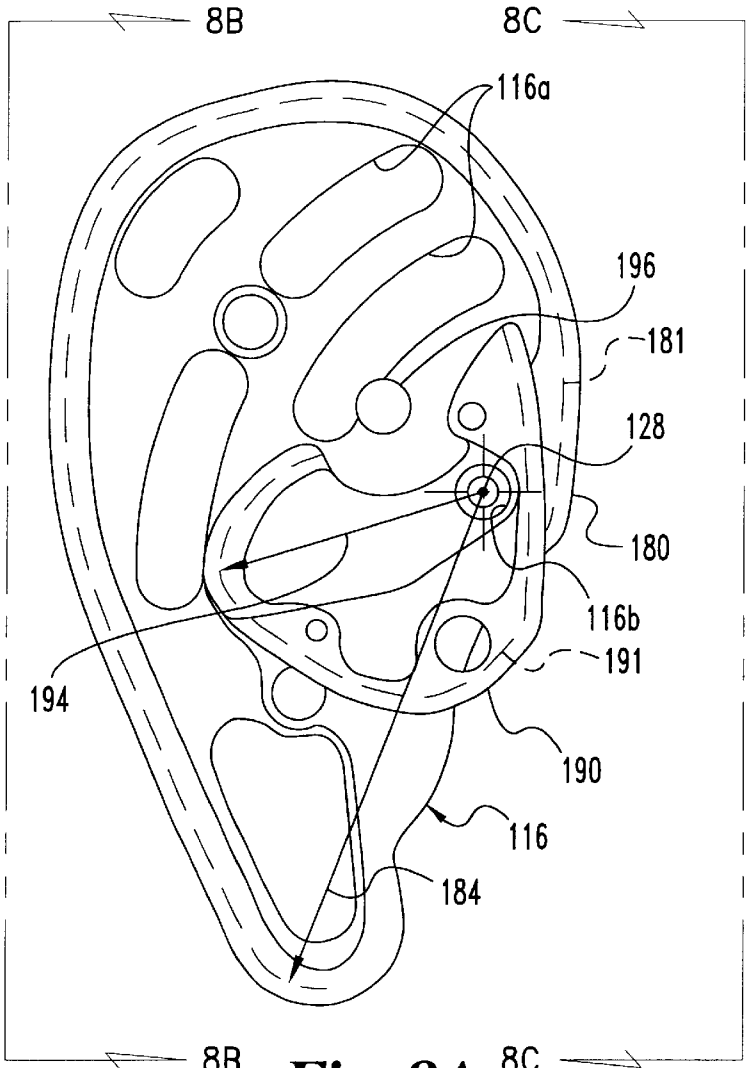

The lower cam wheel 116 of FIG. 3, which corresponds to the wheel for bow limb 130 shown in FIG. 6, is further depicted in FIGS. 8A, 8B, and 8C. FIG. 8A provides a side view of wheel 116. FIG. 8B is an end view of wheel 116 in a view plane perpendicular to the view plane of FIG. 8A and corresponding to view line 8B—8B. FIG. 8C is an end view of wheel 116 in a view plane perpendicular to the view plane of FIG. 8A and corresponding to view line 8C—8C. The upper cam wheel 116 is similarly configured except that it is a mirror image of the lower wheel to provide the requisite let-off as is known to those skilled in the art. Cam wheel 116 defines an axle passage 116*b* for pivotal mounting to a compound bow, and includes a bowstring sheave portion 180 configured to engage bowstring 120 and a take-up string sheave portion 190 configured to engage a segment of cables 112.

Sheave 180 includes the peripheral bowstring track 181 defined by groove 182. Track 181 has a maximum radius 184 originating from rotational axis 128. Sheave 180 also includes at least one anchor knob 186 to secure an end of bowstring 120 thereto. Anchor knob 186 is shown in phantom because it is formed in a recess defined by a central portion of sheave 180. This recess is located in a side of wheel 116 opposite the side affixed to sheave 190. In alternative embodiments, multiple anchor knobs 186 may be included to provide multiple attachment sites for bowstring 120.

Sheave portion 190 has a peripheral take-up string track 191 defined by groove 192. Track 191 has a maximum radius 194. Sheave portion 190 also has an anchor knob 196 to anchor an end of one of cables 112.

String tracks 181 and 191 are shaped to provide a desired let-off curve of draw force versus draw position when incorporated into bow 101. One feature of the present invention is the ratio of the working length for the string tracks 181 and 191. As used herein, "working length" of a string track means that length of the track along which contact by a string or cable nominally changes in going from an undrawn to fully drawn position of the bow. Working length is indicative of the distance that a bowstring or cable winds or unwinds along its respective cam wheel track.

Preferably, a ratio of the working length of the bowstring track 181 to the working length of the take-up string track 191 is at least about 2.5. In a more preferred embodiment, the ratio of the working length of the bowstring track 181 to the working length of the take-up string track 191 is in a range of about 2.5 to 5. Most preferably, the working length ratio is in a range of about 2.8 to 3.5. Likewise, to provide a desired let-off curve, it is preferred that the working length of the cable track be less than about 3.5 inches.

Another feature of the present invention relates to the ratio of the maximum string radius 184 to the maximum cable track radius 194. Preferably, the maximum radius ratio of the maximum string track radius 184 to the maximum cable track radius 194 is at least about 1.75. In a more preferred embodiment, this maximum radius ratio is in a range of about 1.75 to 3. In a most preferred embodiment, the maximum radius ratio is in a range of about 1.8 to 2.4.

Figure 9C:
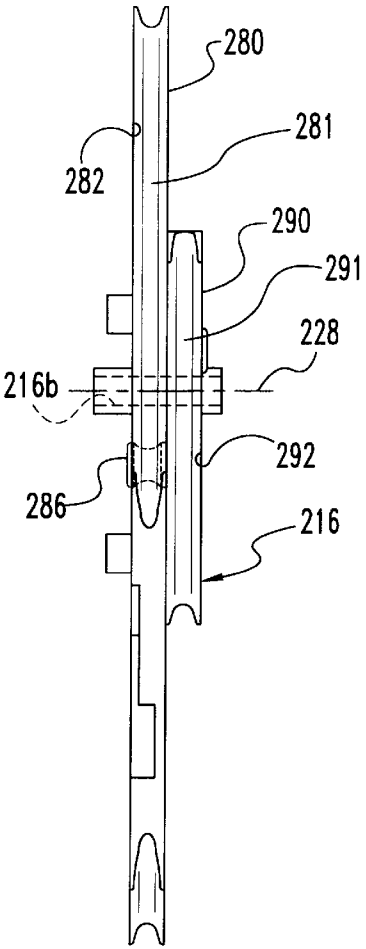
FIGS. 9A, 9B, and 9C illustrate an alternative embodiment of a cam wheel of the present invention.
Figure 9B:
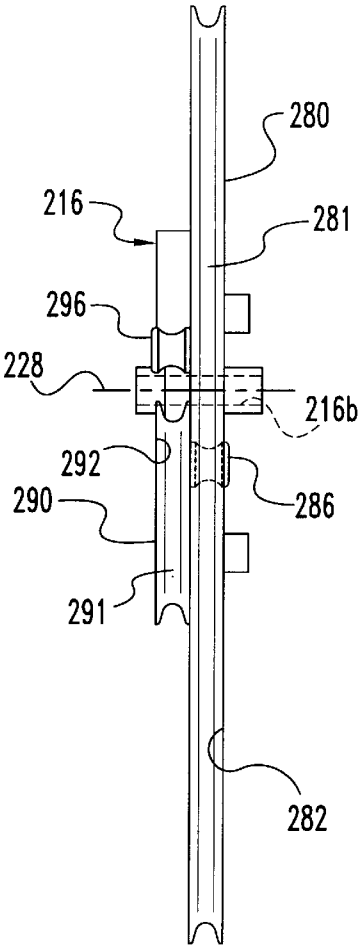
Figure 9A:
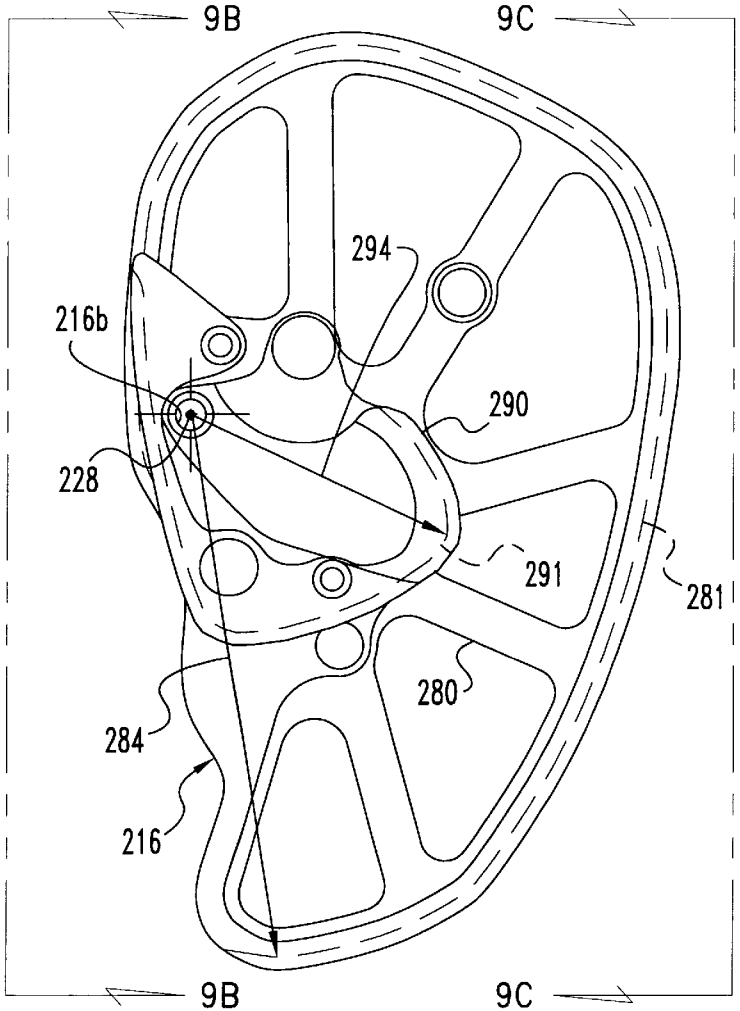

Referring to FIGS. 9A, 9B, and 9C, another embodiment of cam wheel of the present invention is illustrated. FIG. 9A illustrates a side, elevational view of wheel 216. FIG. 9B is an end view of wheel 216 in a view plane perpendicular to the view plane of FIG. 9A and corresponding to view line 9B—9B. FIG. 9C is an end view of wheel 216 in a view plane perpendicular to the view plane of FIG. 9A and corresponding to view line 9C—9C.

Wheel 216 has bowstring sheave portion 280 and take-up string sheave portion 290. An axle bearing passage 216*b* is defined through wheel 216 for eccentric mounting to a compound bow limb to rotate about axis 228 as further described in connection with FIGS. 10A and 10B. Sheave portion 280 has a bowstring track 281 defined by a groove 282 with a maximum radius of 284. Sheave portion 290 has take-up string track 291 defined by groove 292 with a maximum radius 294. Anchor knobs 286, 296 provide for anchoring of a bowstring and take-up string, respectively, to wheel 216.

When incorporated into a compound bow (such as bow 201 of FIGS. 10A–10C), one preferred embodiment of wheel 216 has a ratio of the working length of bowstring track 281 to the working length of take-up string track 291 in a range of about 3.2 to 3.5. Similarly, in one embodiment of wheel 216, it is preferred that a maximum radius ratio of the maximum bowstring radius 284 to maximum take-up string radius 294 be in a range of about 2.2 to 2.4.

Figure 10A:
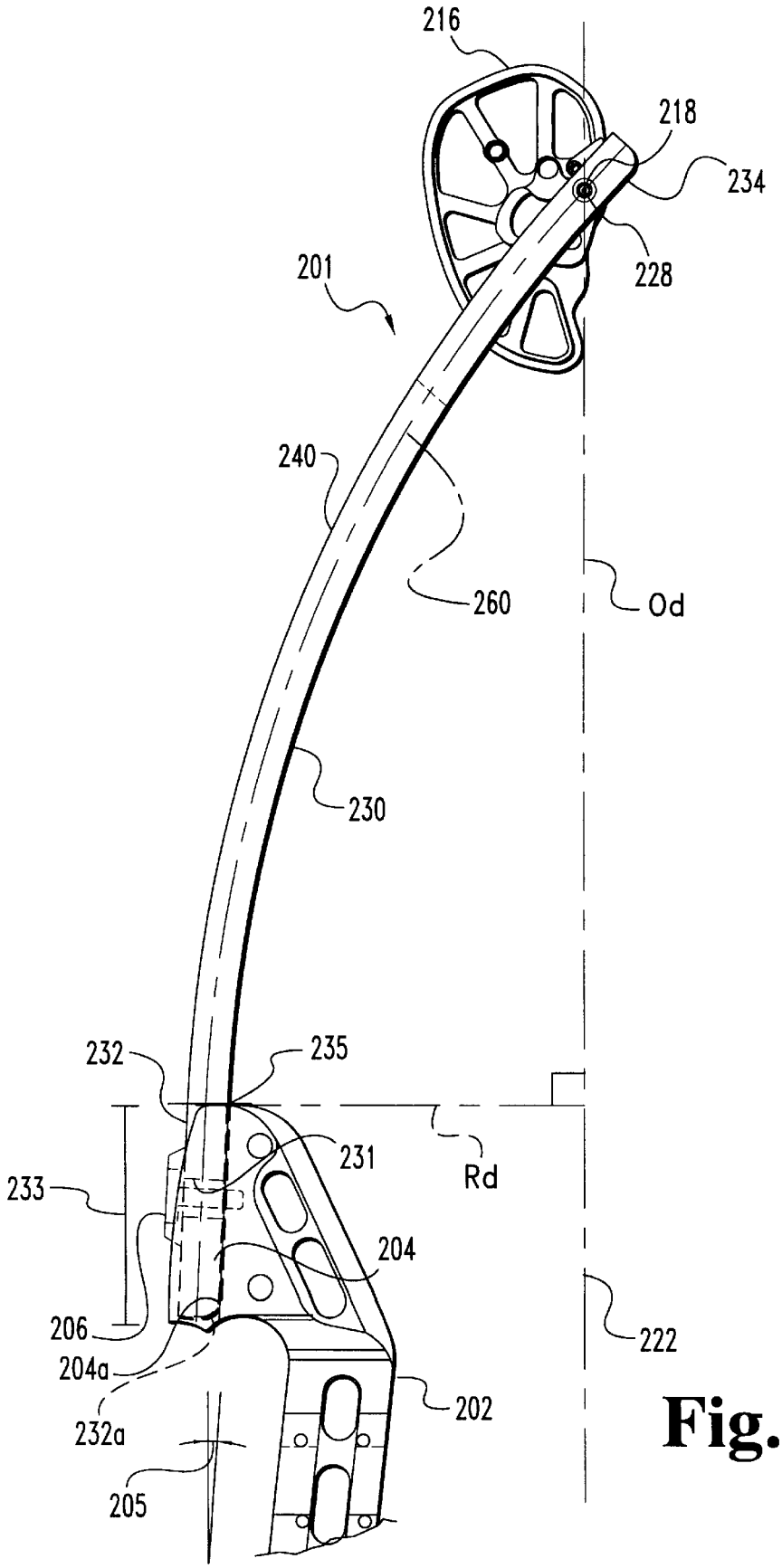
FIG. 10A is a partial side view of an unstrung compound bow of a second preferred embodiment of the present invention utilizing the cam wheel illustrated in FIGS. 9A, 9B, and 9C.

Next, referring to FIG. 10A, wheel 216 is shown assembled in compound bow 201. Only a partial side view of compound bow 201 is illustrated for clarity. Bow 201 has a riser 202 configured with a limb pocket 204. Limb pocket 204 is configured to receive bow limb 230 therein. Limb pocket 204 has a mounting face 204*a* having rake angle 205 of less than about 15°. More preferably, rake angle 205 is less than about 10°. Most preferably, rake angle 205 is between about 0 to 2°. As used herein, "rake angle" is the angle at which a bow limb departs a compound bow riser relative to an axis parallel to the bowstring of the compound bow. Preferably, riser 202 is relatively rigid for its intended use and is made from a suitable metal.

Bow 201 has resilient bow limb 230 preferably manufactured from a composite material in a manner described in connection with the embodiment of FIGS. 3–7. Bow limb 230 has a mounting portion 232 opposing a tip portion 234. A pre-curved portion 240 configured similarly to curved portion 140 of bow limb 130 integrally connects mounting portion 232 and tip portion 234. Pre-curved portion 240 provides a working area designed to flex when bow 201 is drawn. Mounting portion 232 is generally planar and straight and has mounting end 232*a* with a length corresponding to segment 233 along face 204*a*. In one embodiment, the length of segment 233 is about 3 inches. Mounting portion 232 defines a mounting opening 231 configured to receive fastener 206. Opening 231 may be a closed aperture, a keyhole and slot arrangement, or such other arrangement as would occur to one skilled in the art. Preferably, fastener 206 is a torqueable bolt that secures mounting portion 232 against face 204*a*.

Bow limb 230 is configured to follow a path 260 so that rotational axis 228 of wheel 216 is displaced from a point of departure of bow limb 230 by a rearward distance Rd and an outward distance Od. As used herein, "a point of departure" for a compound bow having a bow limb attached to a riser refers the closest point to the riser along a path of the bow limb which is also outwardly displaced from the riser relative to an axle-to-axle axis for the bow. Segment 235 represents a collection of such departure points for bow limb 230. Also, as used herein, "outward" or "outwardly" refers to a direction away from a bow handle or riser of a compound bow along an axle-to-axle axis of the bow, and "rearward" or "rearwardly" refers to a direction toward a bowstring of the bow from the handle or riser along an axis perpendicular to the axle-to-axle axis.

One alternative way to characterize the curvature of bow limb 230 is with the ratio of Rd to Od. Preferably, the ratio of Rd to Od is in a range of about 0.2 to 2. More preferably, this ratio is in a range of about 0.25 to 0.50. Most preferably, this ratio is in a range of about 0.30 to 0.35. Also, it is preferred that Rd be at least 2 inches for a bow limb having a path length of at least 10 inches between mounting end 232*a* and axis 228.

Figure 10B:
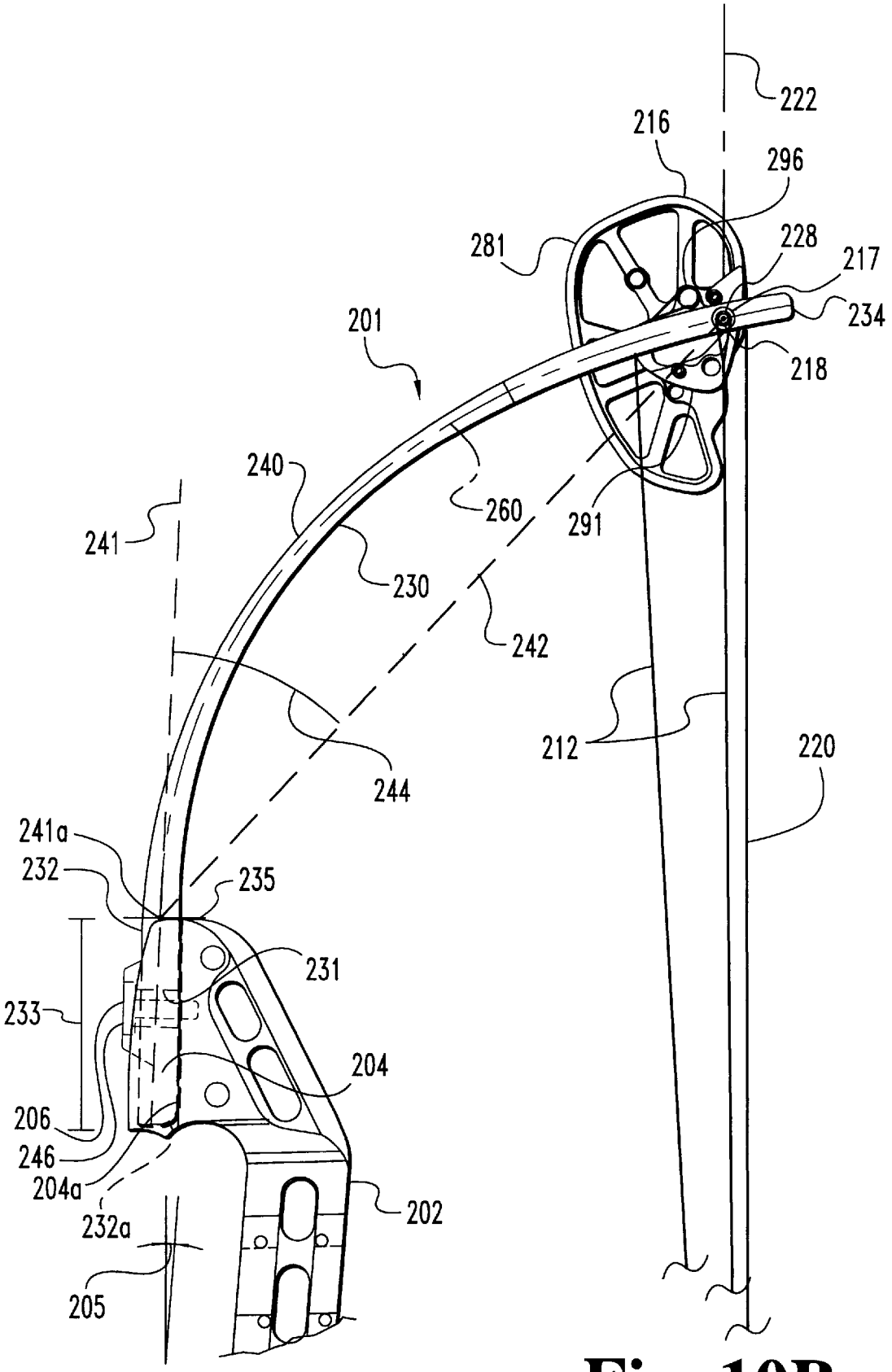
FIG. 10B is a partial side view of the compound bow of FIG. 10A in a strung configuration.
Figure 10C:
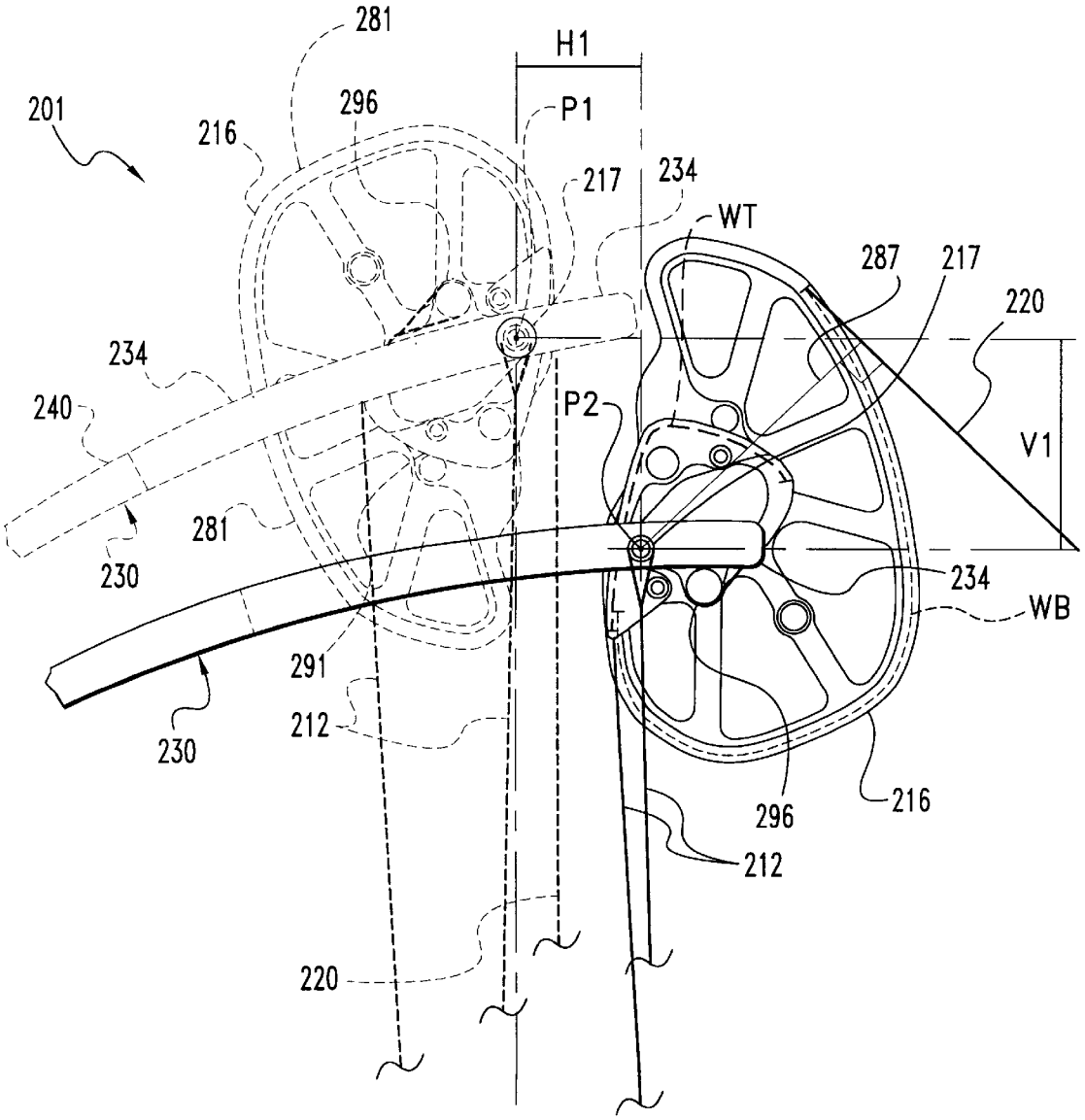
FIG. 10C is a partial side view comparatively illustrating drawn and undrawn positions of the bow of FIGS. 10A and 10B.

In FIG. 10A, tip portion 234 is a free end part of bow limb 230 which is unstrung compared to the configurations of FIGS. 10B and 10C. As used herein, "unstrung" means a bow which has limbs that are not elastically deformed by interconnection with a bowstring, cable, or other device under tension therebetween. Similar to tip portion 134 of bow 101, the free end or tip portion 234 of bow 201 is configured with a pair of opposing arms defining a slot to at least partially receive wheel 216 therein.

Although not completely shown for clarity, bow 201 is preferably configured with a second bow limb/wheel assembly attached to an opposing pocket of riser 202. Each bow limb 230 of bow 201 is generally the same and the cam wheels are likewise the same except each is generally a mirror image of the other. The two bow/limb wheel assemblies of bow 201 are generally symmetrically arranged about an axis perpedicular to axis 222 (not shown) similar to the generally symmetric arrangement of opposing bow limb 130/wheel 116 assemblies of bow 101 about axis 108 in FIG. 3.

Referring additionally to FIG. 10B, bow 201 is shown with bowstring 220 and cable 212 coupled under tension to tip portion 234. The opposing ends of bowstring 220 and cables 212 are mounted to the opposing bow limb/wheel assembly discussed in connection with FIG. 10A (not shown). Tip portion 234 defines axle passage 217 engaged by axle 218 which is intersected by axis 222, and is generally parallel to bowstring 220 when undrawn. Cables 212 include ends mounted in the region of axle 218 and opposing ends terminating at anchor knob 296 similar to cables 112.

Bowstring 220 is mounted to knob 286 to engage bowstring track 281. The stringing and cabling of bow 201 is performed in a manner and using techniques known to those skilled in the art.

The pre-curved portion 240 of bow limb 230 positions tip portion 234 outward and rearward relative to a point of departure selected from segment 235. A tangent axis 241 is tangent to path 260 at a point of departure 241*a* selected from segment 235. Axis 242 intersects point 241*a* and rotational axis 228 to form a rearward angle 244 therebetween. Preferably, rearward angle 244 is at least 30°. More preferably, rearward angle 244 is at least 35°.

Referring to FIG. 10C, a partial side view of a fully drawn position of bow 201 is provided in solid lines with an undrawn position shown in phantom. When drawing bow 201, the draw force at any given point is proportional to the ratio of the moment arm of the bowstring to the take-up string as provided by a cam wheel. This moment arm ratio or "cam ratio" is indicative of the block and tackle function of a cam wheel to provide a mechanical advantage between the force applied to the bowstring by an archer and the force applied to the bow limbs. As used herein, "cam ratio" of a cam wheel may be defined as the ratio of the perpendicular distance between the rotational axis of the cam wheel to a point of tangency of the bowstring divided by the perpendicular distance between the rotational axis and a point of tangency with the take-up string (or cable) for any given drawn position of the cam wheel. U.S. Pat. Nos. 5,495,843 to Larson and 4,515,142 to Nurney are cited as additional sources of general background information concerning compound bow cam ratios.

Referring to the undrawn position of bow 201, the rotational axis 228 corresponds to point P1. Similarly, for the drawn position indicated, the rotational axis corresponds to point P2. One example of a bowstring track moment arm 287 for the fully drawn position corresponding to point P2 is provided. The take-up string moment arms for points P1 and P2, and the bowstring moment arm for point P1 are omitted for clarity.

For one embodiment of the present invention, a table of the bowstring moment arm, take-up string moment arm, and the resulting cam ratio for several draw positions are indicated (draw position and moment arm values are in inches and the cam ratio is unitless):

| Draw | MOMENT ARM | | CAM RATIO |
|---|---|---|---|
| Position | String | Take-up String | String/Cable |
| 10 | 0.438 | 1.563 | 0.28 |
| 12 | 0.688 | 1.626 | 0.42 |
| 14 | 1.063 | 1.626 | 0.65 |
| 16 | 1.563 | 1.563 | 1.00 |
| 18 | 2.001 | 1.438 | 1.39 |
| 20 | 2.376 | 1.376 | 1.73 |
| 22 | 2.688 | 1.25 | 2.15 |
| 24 | 2.813 | 1.126 | 2.50 |
| 26 | 2.626 | 0.876 | 3.00 |
| 28 | 2.313 | 0.626 | 3.69 |
| 30 | 2.813 | 0.313 | 8.99 |

This table corresponds to measurements taken for a compound bow configured similar to bow 101 depicted in FIGS. 3–8. Measurements for compound bow 201 may differ slightly. For one embodiment of the present invention, it is preferred that the cam ratio be at least about 5 for a drawn position of the bow. More preferably, the cam ratio is in a range of about 7 to 11 for a fully drawn position.

As illustrated in FIG. 10C, bowstring 220 unwinds from bowstring track 281 as it is drawn to move rotational axis 228 of wheel 216 from position P1 to position P2. The corresponding working length WB of bowstring track 281 is illustrated as the distance bowstring 220 unwinds as bowstring 220 is drawn. Conversely, working length WT of take-up string track 291 corresponds to the distance that cable 212 winds onto track 291 as bowstring 220 is drawn. Notably, upon release of bowstring 220 to shoot an arrow, bowstring 220 winds back onto track 281 and cable 212 unwinds from track 291.

FIG. 10C also illustrates other comparative aspects of bow 201. As the rotational axis 228 moves from position P1 in an undrawn state to position P2 in a fully drawn position, a positional change occurs along the axle-to-axle axis 222. The distance along axis 222 corresponding to the separation of P1 and P2 is designated V1. Similarly, the separation of P1 and P2 in a direction perpendicular to axis 222 is designated as distance H1. Preferably, the ratio of V1 to H1 is greater than about 1. More preferably, the ratio of V1 to H1 is greater than about 2. Most preferably, the ratio of V1 to H1 is at least about 3.

Generally, the ratio of V1 to H1 reveals that bow limb deflection is greater along the axle-to-axle axis than the axis along which an arrow travels. Because of the symmetric arrangement of the bow limbs, the forces associated with the V1 deflection when the bow is released from a fully drawn position tend to cancel each other; and thus do not typically degrade accuracy. Also, because deflection along H1 and corresponding forces may be greatly reduced in comparison to existing bows, the present invention represents a significant improvement in terms of accuracy.

All publications, patents, and patent applications cited in this specification are herein incorporated by reference as if each individual publication, patent, or patent application were specifically and individually indicated to be incorporated by reference and set forth in its entirety herein.

While the invention has been illustrated and described in detail in the drawings and foregoing description, the same is to considered as illustrative and not restrictive in character, it being understood that only the preferred embodiment has been shown and described and that all changes and modifications that come within the spirit of the invention are desired to be protectable.

What is claimed is:

1. A bow limb prior to assembly with a riser, a riser fastener, a cam wheel, and a cam wheel axle to provide a compound archery bow, comprising:

a mounting portion terminating in a mounting end, said mounting portion defining a mounting opening therethrough configured to receive the riser fastener;

a tip portion defining a slot between a pair of arms, said arms each defining an axle passage configured to receive the axle to mount the cam wheel at least partially within said slot;

a curved portion integrally connecting said mounting portion and said tip portion, said curved portion being configured to rearwardly and outwardly extend said tip portion away from the riser when said mounting portion is fastened to the riser, said curved portion having a radius of curvature of less than about 30 inches, said radius sweeping an angle of at least about 35 degrees; and wherein the bow limb is made from a composite material with a polymeric resin and follows a path from said mounting end to said axle passage configured to displace said axle passage from said mounting end a rearward distance of at least about 2 inches when said mounting portion is fastened to the riser.

2. The bow limb of claim 1, wherein the bow limb has no reverse curvature between said mounting portion and said axle passage.

3. The bow limb of claim 1, wherein said radius of curvature is in a range of 18 to 22 inches and said angle is in a range of about 37 to 42 degrees.

4. The bow limb of claim 1, wherein said curved portion has a region generally thinner than said mounting portion and said tip portion, said radius is about 20 inches, said angle is in a range of about 39 to 41 degrees, and said axle passage is displaced from said mounting end along said axis by at least 4 inches.

5. The bow limb of claim 1, wherein said composite material includes glass or graphite fibers.

6. The bow limb of claim 1, wherein:

said bow limb has no reverse curvature between said mounting portion and said axle passage;

said radius of curvature is in a range of 18 to 22 inches and said angle is in a range of about 37 to 42 degrees; and said composite material includes glass or graphite fibers.

7. A bow limb prior to assembly with a riser, a riser fastener, a cam wheel, and a cam wheel axle to provide a compound archery bow, comprising:

a mounting portion configured for fastening to the riser by the riser fastener;

a tip portion defining a slot between a pair of arms, said arms each defining an axle passage configured to receive the axle to mount the cam wheel at least partially within said slot;

a curved portion integrally connecting said mounting portion and said tip portion, said curved portion being configured to rearwardly and outwardly extend said tip portion away from the riser when said mounting portion is fastened to the riser, said curved portion having a radius of curvature of less than about 30 inches, said radius sweeping an angle of at least about 35 degrees, and said curved portion having no reverse curvature.

8. The bow limb of claim 7, wherein said radius of curvature is in a range of 18 to 22 inches and said angle is in a range of about 37 to 42 degrees.

9. The bow limb of claim 7, wherein said curved portion has a region generally thinner than said mounting portion and said tip portion, said radius is about 20 inches, said angle is in a range of about 39 to 41 degrees, and said axle passage is displaced from said mounting end along said axis by at least 4 inches.

10. The bow limb of claim 7, wherein the bow limb is formed from a composite material including glass or graphite fibers.

* * * * *